US006857542B1

(12) United States Patent
Mettler et al.

(10) Patent No.: US 6,857,542 B1
(45) Date of Patent: Feb. 22, 2005

(54) ORIFICE REDUCER FOR CONTAINER NECK

(75) Inventors: Mark F. Mettler, Spring Lake, MI (US); Jay R. Dittmer, Ada, MI (US); Mark K. White, Grand Rapids, MI (US)

(73) Assignee: Access Business Group International LLC, Ada, MI (US)

( * ) Notice: Subject to any disclaimer, the term of this patent is extended or adjusted under 35 U.S.C. 154(b) by 0 days.

(21) Appl. No.: 10/383,824

(22) Filed: Mar. 7, 2003

(51) Int. Cl.[7] ..... B67D 5/00

(52) U.S. Cl. ..... 222/546; 222/547; 222/564; 222/562; 222/569

(58) Field of Search ..... 222/544–547, 222/562–564, 566, 567, 569, 570; 215/386, 387; 220/694

(56) References Cited

U.S. PATENT DOCUMENTS

| | | | | | |
|---|---|---|---|---|---|
| 762,818 | A | * | 6/1904 | Garwood | 222/542 |
| 2,275,185 | A | | 3/1942 | Shinn | |
| 2,529,424 | A | * | 11/1950 | Seigh | 222/562 |
| 2,767,744 | A | | 10/1956 | Beerman | |
| 3,118,578 | A | | 1/1964 | Collins | |
| 3,149,758 | A | | 9/1964 | Bush | |
| 3,155,281 | A | | 11/1964 | Stacey | |
| 4,022,352 | A | * | 5/1977 | Pehr | 222/153.14 |
| 5,219,101 | A | | 6/1993 | Matkovich et al. | |
| 5,305,932 | A | | 4/1994 | Iseli | |
| 5,431,204 | A | | 7/1995 | Neward | |
| 5,490,545 | A | | 2/1996 | Sokoloff et al. | |
| 5,839,614 | A | | 11/1998 | Brown | |
| 5,850,908 | A | | 12/1998 | Jasek | |
| 6,062,436 | A | | 5/2000 | Fuchs | |
| 6,076,709 | A | | 6/2000 | Wilner | |
| 6,105,828 | A | | 8/2000 | Kanner et al. | |
| 6,199,725 | B1 | | 3/2001 | Garibaldi | |
| 6,279,783 | B1 | | 8/2001 | Brown et al. | |
| 6,283,316 | B1 | | 9/2001 | Sherman | |
| 6,308,866 | B1 | * | 10/2001 | Hoang et al. | 222/189.11 |
| 6,315,140 | B1 | | 11/2001 | Nadel | |

* cited by examiner

*Primary Examiner*—J. Casimer Jacyna
(74) *Attorney, Agent, or Firm*—Warner Norcross & Judd

(57) ABSTRACT

An orifice reducer with crumple zones well suited for use with an extrusion blow molded bottle having an uneven surface finish. The device includes a circumferential wall having a number of vertically extending reduced thickness regions, preferably spaced symmetrically about the circumferential wall. The reduced thickness regions deform upon insertion of the orifice reducer into the neck of a bottle to account for irregularity of the surface finish of the bottle. This allows the orifice reducer to be more easily inserted into standard extrusion blow molded bottles.

40 Claims, 5 Drawing Sheets

ORIFICE REDUCER FOR CONTAINER NECK

BACKGROUND OF INVENTION

The present invention relates to containers and, more specifically, to an orifice reducer for a container neck.

In general, the neck of a typical container is fairly large in relation to the overall outer diameter of the container. The relatively large orifice makes the container easier to fill during the packaging process. In addition, several methods of forming plastic containers, such as injection blow molding and extrusion blow molding, inherently result in a neck of relatively large diameter.

In many applications, it is desired to have a container opening that is smaller than the neck opening in the final consumer application. A smaller neck opening typically makes it easier to control dispensing of the product, producing less wasted product. Examples of where a reduced orifice is desirable are where the container houses an expensive product that is used in relatively small quantities and where the contents of the container must be carefully dispensed in a controlled manner.

To achieve this goal, orifice reducers have been developed in the industry. A conventional orifice reducer generally includes a plastic plug with a center aperture that is inserted in the neck of a container. The center aperture is typically considerably smaller than the neck of the container. This reduces the effective size of the opening and reduces the rate at which a product is dispensed from a container, thus giving the consumer greater control and decreasing the amount of product wasted.

In general, conventional orifice reducers include a top wall positioned atop a circumferential wall. The circumferential wall is sized to be securely fitted into the neck of the bottle. The top wall closes the relatively large neck opening and includes its own smaller opening that is sized to provide the desired volume of flow from the bottle. In some applications, the top wall will have a greater diameter than the circumferential wall so that it covers the top edge of the bottleneck. This provides aesthetic benefits and also helps to prevent the orifice reducer from being inserted too far into the container neck.

Conventional orifice reducers can, however, be relatively difficult to insert in containers with irregularly sized or irregularly shaped neck openings. When a conventional orifice reducer is inserted into an irregularly sized or shaped neck opening, the circumferential wall will not fit cleanly into the opening. Instead, the orifice reducer must deform to match the size and shape of the container neck. The force required to cause the orifice reducer to deform can be significant. So much so, in some applications, that conventional packaging machinery is not capable of performing the insertion. As a result, expensive, custom manufactured machinery is sometimes necessary with conventional orifice reducers. Further, deformation of the circumferential wall may cause buckles or other sever deformations that may impair the ability of the orifice reducer to seal against the inside of the container neck.

SUMMARY OF THE INVENTION

The aforementioned problems are overcome by the present invention wherein an orifice reducer is provided with a circumferential wall that includes vertically extending regions of reduced thickness. The reduced regions provide "crumple" zones that permit the orifice reducer to collapse in a controlled manner when inserted into the container neck. More specifically, the reduced regions provide the wall with regions of increased flexibility that reduce the hoop strength of the wall and facilitate controlled deformation. This allows the orifice reducer to be more easily inserted into openings that are smaller in diameter or irregularly shaped.

In a preferred embodiment, the orifice reducer includes a circular top wall and a downwardly extending circumferential wall. The circumferential wall preferably has an outer diameter slightly greater than the inner diameter of the container neck so that the orifice reducer is frictionally fitted into the container neck. The circumferential wall preferably defines a plurality of vertically extending notches that are spaced radially symmetrically about the wall. The notches preferably open inwardly so that the outer surface of the orifice reducer (i.e. the surface engaging the container neck) is relatively uniform.

The present invention also provides a method for manufacturing an orifice reducer including the steps of (a) forming a top wall having an orifice, (b) forming a circumferential wall extending from the top wall, and (c) defining vertically extending reduced regions in the circumferential wall. In a preferred embodiment, all of these steps are performed essentially simultaneously through injection molding.

The present invention provides a simple and effective orifice reducer that offers significant advantages over prior art orifice reducers. The crumple zones reduce the hoop strength of the circumferential wall, thereby permitting the orifice reducer to be more easily inserted into irregular sized and shaped openings. Because of its reduced insertion force, the orifice reducer of the present invention permits conventional factory equipment to be used to insert the orifice reducer into irregularly shaped and sized container necks. As a result, the present invention eliminates the need to modify or replace existing factory equipment, thereby significantly reducing the costs associated with the assembly of such bottles. Further, by providing controlled deformation of the orifice reducer, the present invention reduces the likelihood of severe deformations that might cause leaking between the orifice reducer and container neck.

These and other objects, advantages, and features of the invention will be readily understood and appreciated by reference to the detailed description of the preferred embodiment and the drawings.

DETAILED DESCRIPTION OF THE PREFERRED EMBODIMENTS

Figure 1:
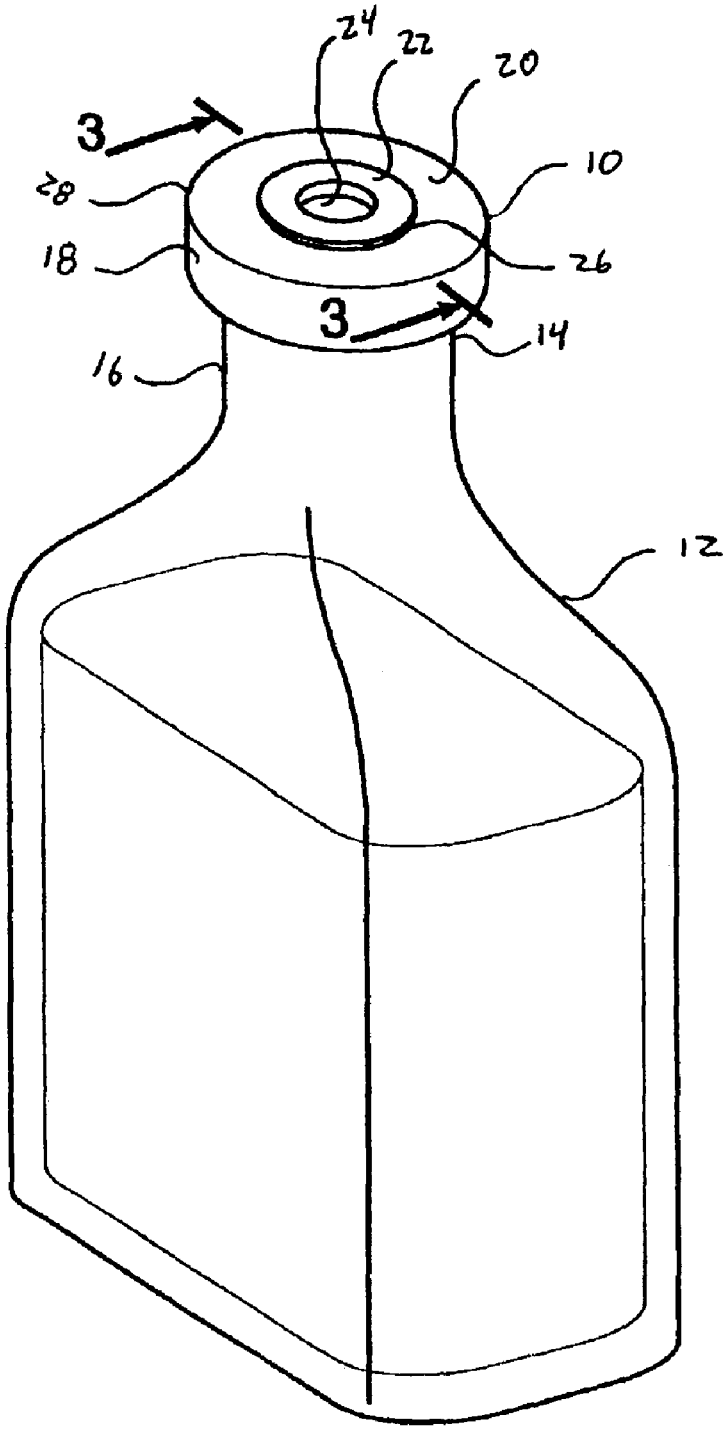
FIG. 1 is a perspective view of a bottle utilizing an orifice reducer manufactured in accordance with a preferred embodiment of this invention.
Figure 2:
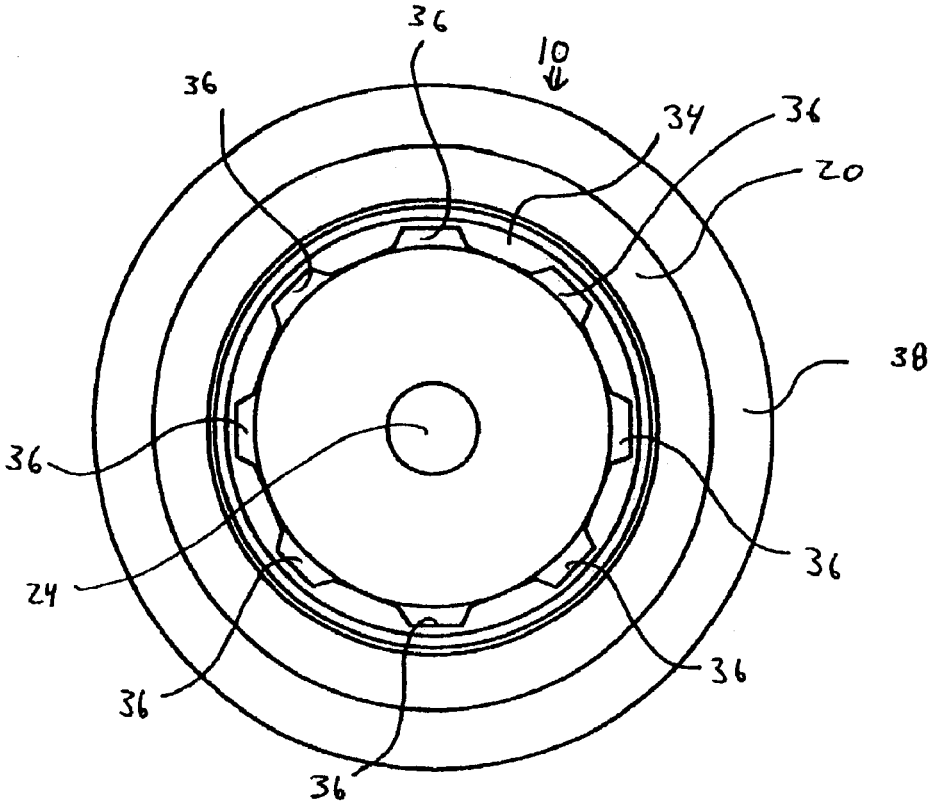
FIG. 2 is a bottom view of the orifice reducer.

A bottle 12 incorporating an orifice reducer 10 manufactured in accordance with a preferred embodiment of the present invention is shown in FIG. 1. The bottle 12 has a top end 14 and includes a neck 16. The neck 16 defines a substantially circular opening. The orifice reducer 10 is fitted onto the bottle neck 16 and defines a relatively small aperture 24 through which the contents of the bottle are dispensed. The orifice reducer 10 includes a circumferential wall 34 that is fitted within the bottle neck 16. The circumferential wall 34 shown in FIGS. 2–5 includes reduced thickness regions (or "crumple zones") that facilitate insertion of the orifice reducer. For purposes of disclosure, a preferred embodiment of the orifice reducer 10 is described in connection with a conventional extrusion blow molded plastic bottle. The orifice reducer can, however, be used in connection with essentially any conventional container having a neck that requires some form of orifice reduction.

The orifice reducer 10 will now be described in greater detail with reference to FIGS. 2–5. In general, the orifice reducer 10 includes a top wall 20, an aperture rim 22, a circumferential wall 34 and an outer wall 18. The top wall 20 is preferably a substantially circular panel. An aperture 24 is defined approximately at the center of the top wall 20 through which product can be dispensed from the bottle 12. In a preferred embodiment the aperture 24 is substantially circular, although it can alternatively be of essentially any shape. The aperture rim 22 preferably protrudes upwardly from the top wall 20 and surrounds the aperture 24. The aperture rim 22 provides an improved sealing interface with the container closure, for example, a threaded cap. The aperture 24 extends through both the aperture rim 22 and the top wall 20. The edge 26 of the aperture rim 22 preferably does not extend to the edge 28 of the top wall 20.

The outer wall 18 is a substantially continuous wall extending downwardly from the peripheral edge 28 of the top wall 20 to cover an upper portion of the bottle neck 16. In a preferred embodiment, the outer wall 18 is substantially circumferential. The diameter of the outer wall 18 is preferably such that when the orifice reducer 10 is inserted into the neck 16 of the bottle 12, the outer wall 18 surrounds the outer surface of the neck 16. The inner diameter of the outer wall 18 can be selected to closely fit around the bottle neck 16 or it can be reduced so that the bottle neck 16 is compressingly received between the outer wall 18 and the circumferential wall 34.

Figure 3A:
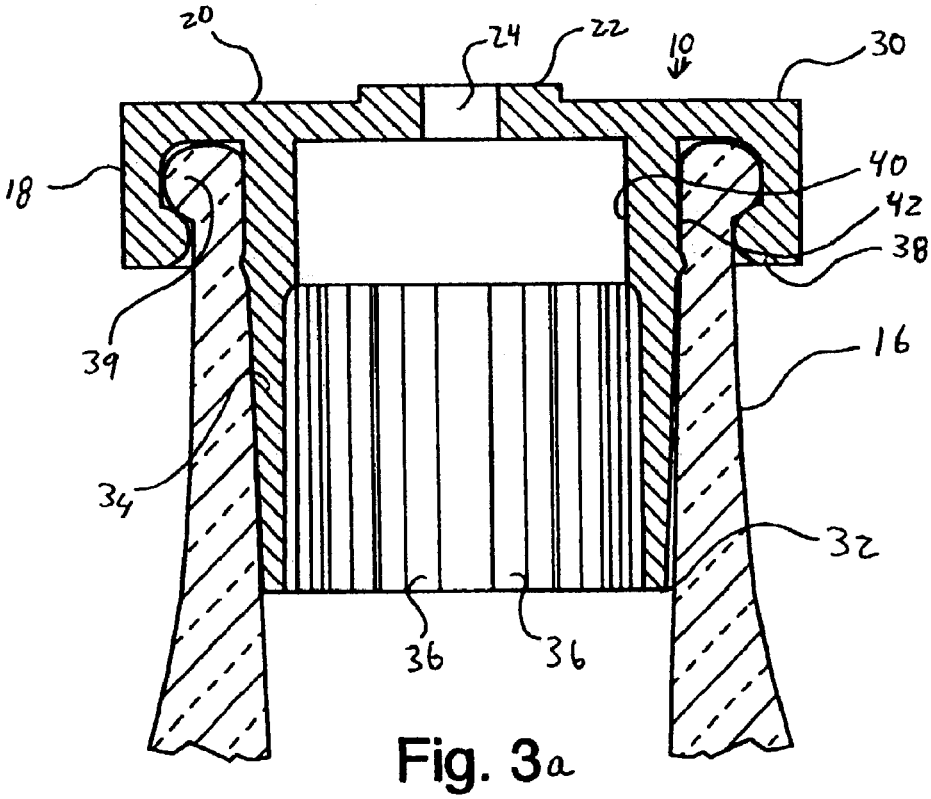
FIG. 3*a* is a cross-sectional fragmentary view of the bottle and orifice reducer taken along line 3—3.

As can be seen more clearly in FIG. 3*a*, the outer wall 18 optionally includes a lip 38. The lip 38 protrudes from the bottom end of the outer wall 18, extending perpendicularly inward (i.e. toward the center) from the bottom end of the outer wall 18. The lip 38 is preferably continuous around substantially the entire circumference of the outer wall 18, but can be discontinuous, if desired. The lip 38 is designed to snap around the ridge 39 of the neck 16 of the bottle 12. The precise shape and dimensions of the lip 38 will vary depending, in part, upon the dimensions of the bottle 12 and the amount of force desired to insert and remove the orifice reducer. Although the lip 38 is illustrated as being substantially semicircular in cross section, it may alternatively take on other cross sections. For example, the lip may alternatively be "ratchet-shaped" having a ramped bottom surface and a flat top surface. The ramped bottom surface facilitates insertion while the flat top surface resists removal.

Figure 3B:
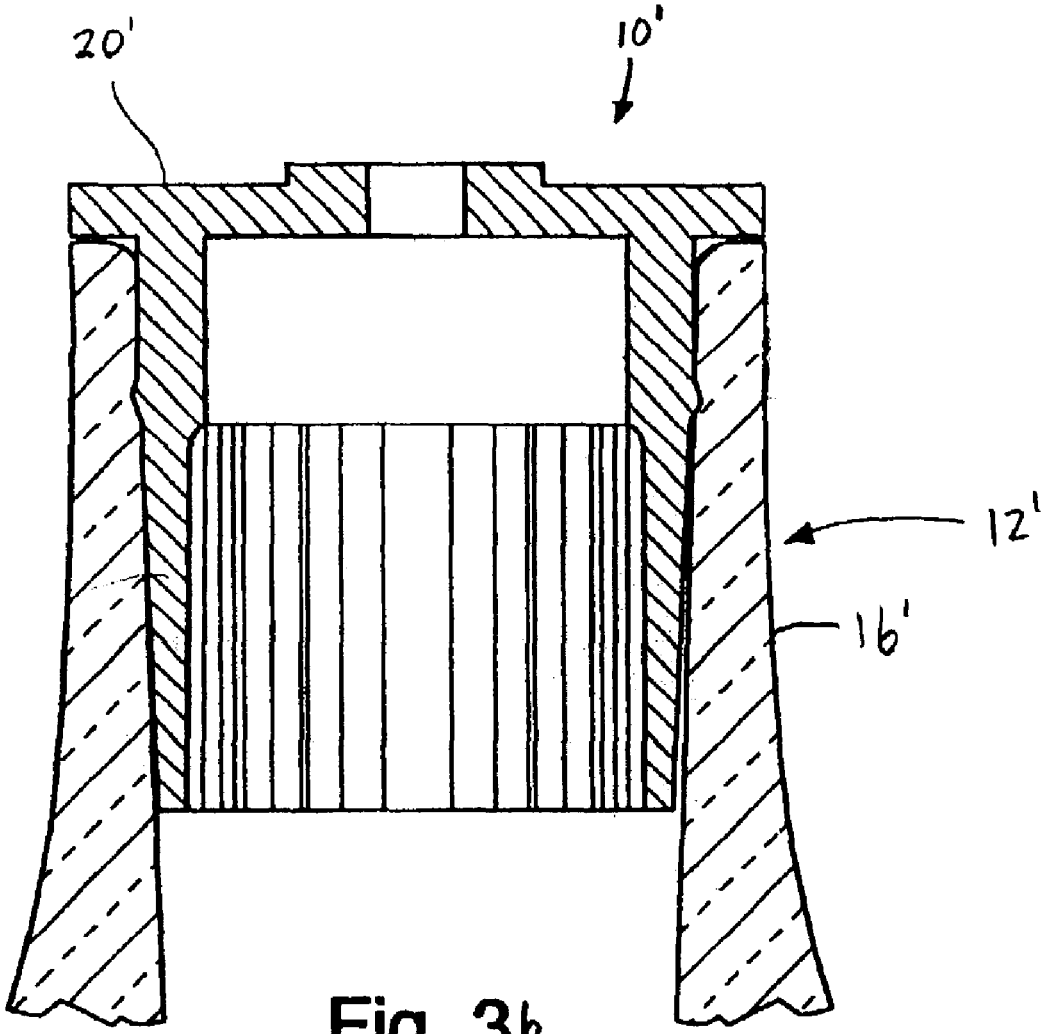
FIG. 3*b* is a cross-sectional fragmentary view of an alternative bottle and orifice reducer similar to FIG. 3*a;*
Figure 4:
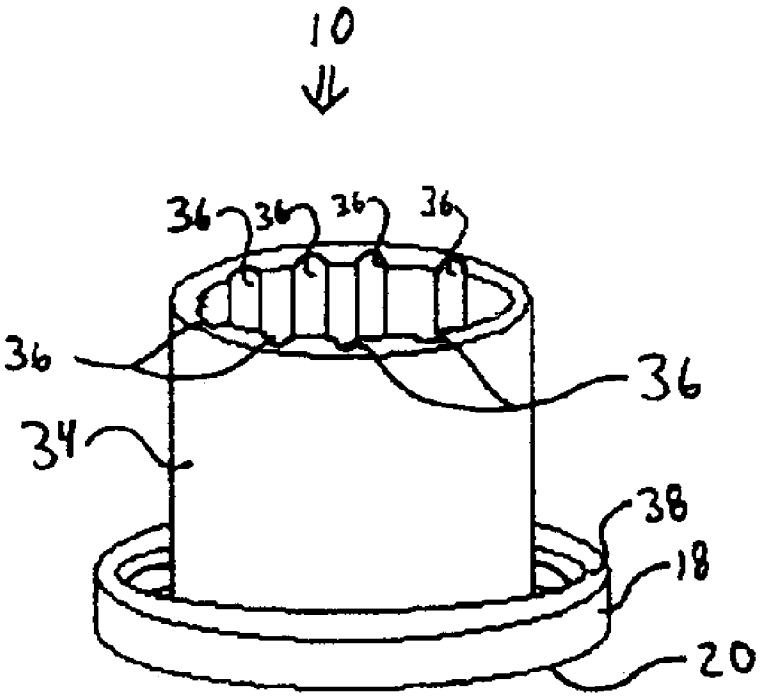
FIG. 4 is a bottom perspective view of the orifice reducer.
Figure 5:
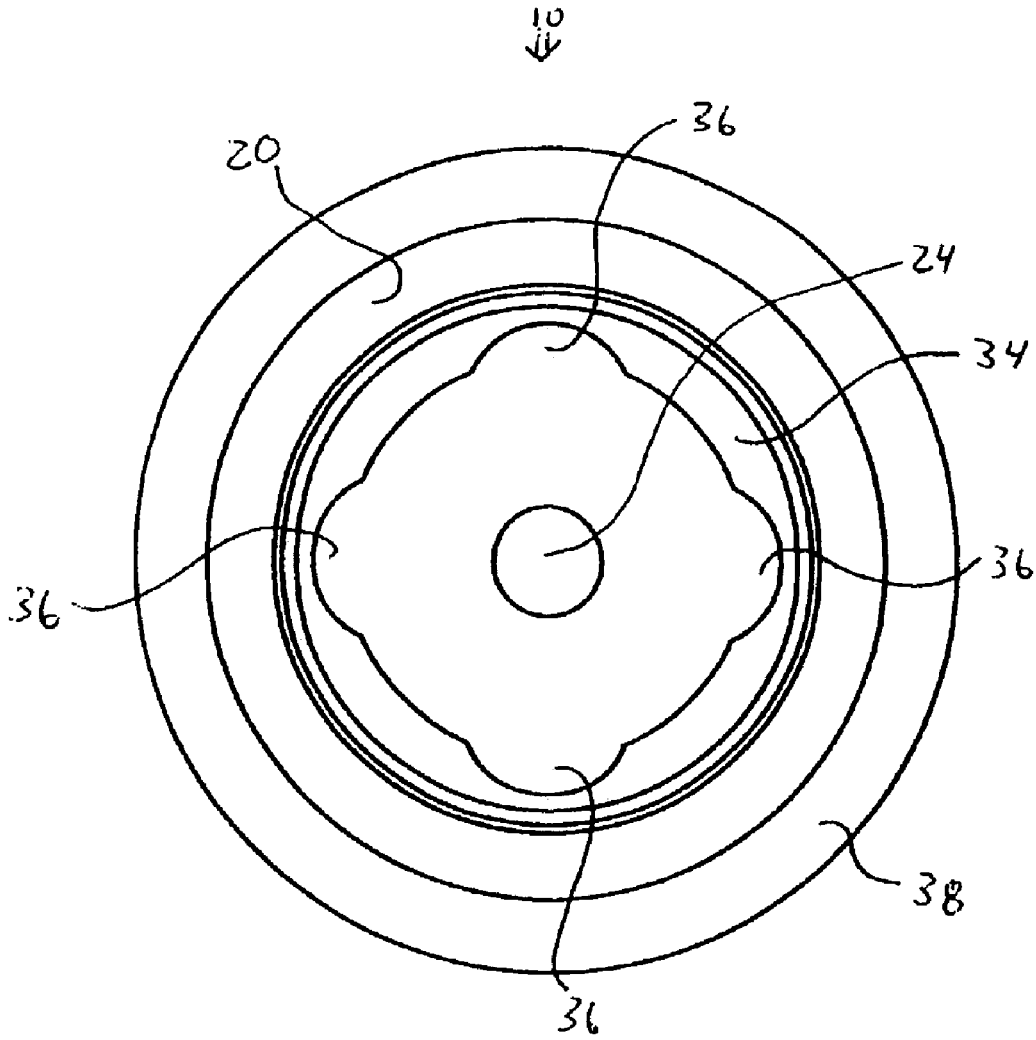
FIG. 5 is a bottom view of an alternate embodiment of the orifice reducer.

An alternative embodiment of the invention is shown in FIG. 3*b*. In this figure, the outer wall 20, including lip 18, are no longer included on the orifice reducer 10'. The top wall 20' of the orifice reducer 10' terminates substantially flush or slightly indented with respect to the side wall 16' of the bottle 12'.

In a preferred embodiment, the circumferential wall 34 has an internal side 40 and an external side 42. The circumferential wall 34 defines a plurality of notches 36, preferably on the internal side 40 of the circumferential wall 34. A notch 36 is a thinned region of the circumferential wall and, in a preferred embodiment, is a vertical, substantially rectangular thinned region of the cicumferential wall 34. Each notch 36 preferably extends at least half the height of the circumferential wall 34, with the notch 36 typically, but not necessarily, originating at the bottom end 32 of the circumferential wall 34. To create notches 36, the a circumferential wall 34 having thinned regions can be created by any conventional method, but in a preferred embodiment the orifice reducer 10 is injection molded and the notches are integrally manufactured into the circumferential wall 34 during the injection molding process. In a further preferred embodiment each notch 36 penetrates approximately one-half of the thickness of the circumferential wall 34. The notches 36 are preferably equally spaced around the circumference of the internal side 40 of the circumferential wall 34. Any number of notches 36 can be used, but in a preferred embodiment there are eight equally spaced notches 36. In an alternate embodiment; shown in FIG. 5, each notch 36 is substantially semicircular. The precise size, shape and location of the reduced regions can vary from application to application depending in large part on the degree of irregularity anticipated in the bottle and the amount of flexibility desired in the circumferential wall.

An orifice reducer 10 according to the present invention is preferably manufactured by a plastic molding process as an integral piece. The mold used preferably defines all aspects of the orifice reducer 10, including the top wall 20, aperture 24, aperture rim 22, circumferential wall 34, notches 36, outer wall 18 and lip 38. In a more preferred embodiment, the orifice reducer 10 is injection molded. Optionally, the orifice reducer 10 can be molded without notches 36, and the notches 36 can be added to the circumferential wall 34, for example, using a file or similar machining device. The orifice reducer is preferably injection molded from low density polyethylene (LDPE) or other similar materials.

In use, the orifice reducer 10 is inserted in the bottle neck after the bottle 12 has been filled with the desired contents. To insert, the orifice reducer 10 is placed atop the neck 16 of a bottle 12 so that the bottom end 32 of the circumferential wall 34 is in contact with the neck 16. If desired, the bottom outer surface of the circumferential wall 34 can be tapered somewhat to facilitate initial insertion of the orifice reducer into the neck opening. Downward pressure is applied to the top wall 20 of the orifice reducer 10 until the circumferential wall 34 is inserted into the neck 16. As the circumferential wall 34 is inserted into the neck 16, the thinned regions 36 of the orifice reducer 10 deform to account for irregularities in the size, shape or surface finish of the neck 16. Pressure is placed on the orifice reducer 10 until the top wall 20 rests on the top end 14 of the neck 16. In this position, the lip 38, if present, will be snapped around the ridge 39 of the neck 16. A conventional closure (not shown), such as a threaded or snap-on cap, can then be added to the bottle 12. To dispense the contents, the cap (not shown) is removed and the bottle 12 is tilted or inverted to dispense its contents through the aperture 24 of the orifice reducer 10.

The above description is that of preferred embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a,"

"an," "the" or "said" is not to be construed as limiting the element to the singular.

What is claimed is:

1. An orifice reducer for the neck of a container comprising:

a top wall having a thickness, said top wall defining an aperture through said thickness;

a circumferential wall extending into the neck of the container, said circumferential wall having a thickness, said circumferential wall being substantially continuous and extending from said top wall; and one or more vertically extending reduced thickness regions defined in said circumferential wall.

2. The orifice reducer of claim 1, wherein said circumferential wall has an internal side and said reduced thickness regions are located on said internal side of said circumferential wall.

3. An orifice reducer comprising:

a top wall having a thickness, said top wall defining an aperture through said thickness and an edge;

a circumferential wall having a thickness and an internal side, said circumferential wall being substantially continuous and extending from said top wall; and one or more vertically extending reduced thickness regions defined in said internal side of said circumferential wall; and an outer wall extending from said top wall.

4. The orifice reducer of claim 3, wherein each of said circumferential wall and said outer wall has a perimeter, said edge of said top wall, said perimeter of said circumferential wall, and said perimeter of said outer wall being substantially circular.

5. The orifice reducer of claim 4, wherein said outer wall includes a bottom end, further including a lip protruding substantially perpendicularly from said bottom end of said outer wall in the direction of said circumferential wall.

6. The orifice reducer of claim 5, wherein said lip is substantially continuous along said bottom end of said outer wall.

7. The orifice reducer of claim 6, wherein said top wall includes a top surface, further including an aperture rim protruding from said top surface of said top wall, said aperture rim defining an edge and surrounding said aperture.

8. The orifice reducer of claim 7, wherein said aperture rim is substantially circular and said edge of said aperture rim does not extend to said edge of said top wall.

9. The orifice reducer of claim 8, wherein said circumferential wall includes a plurality of reduced thickness regions.

10. The orifice reducer of claim 9, wherein said plurality of reduced thickness regions are radially symmetrically spaced.

11. The orifice reducer of claim 10, wherein said reduced thickness regions are defined by notches.

12. The orifice reducer of claim 11, wherein said notches are substantially rectangular.

13. The orifice reducer of claim 11, wherein said notches are substantially semicircular.

14. The orifice reducer of claim 11, wherein said circumferential wall has a height and a bottom end, and said notches extend at least approximately one half of said height of said circumferential wall, each of said notches extending to said bottom end of said circumferential wall.

15. The orifice reducer of claim 14, wherein each of said notches penetrates approximately one-half of said thickness of said circumferential wall.

16. An orifice reducer comprising:

a circumferential wall having a first end, a second end, an inner surface, an external surface, and a thickness;

an end wall closing one of said first end and said second end of said circumferential wall, said end wall extending past said external surface of said circumferential wall said end wall defining an aperture; and one or more axially extending reduced thickness regions defined in said circumferential wall.

17. The orifice reducer of claim 16, wherein said reduced thickness regions are located on said inner surface of said circumferential wall.

18. The orifice reducer of claim 17, wherein said end wall is a top wall having a bottom surface, said first end of said circumferential wall extending from said bottom surface.

19. An orifice reducer comprising:

a circumferential wall having a first end, a second end, an inner surface, and a thickness;

an end wall closing one of said first end and said second end of said circumferential wall, said end wall defining an aperture, wherein said end wall is a top wall having a bottom surface, said first end of said circumferential wall extending from said bottom surface; and one or more axially extending reduced thickness regions defined in said circumferential wall, wherein said reduced thickness regions are located on said inner surface of said circumferential wall; and an outer wall extending from said bottom surface of said top wall.

20. The orifice reducer of claim 19, wherein said outer wall includes an inner surface and further including a lip protruding from said inner surface of said outer wall.

21. The orifice reducer of claim 20, wherein said top wall includes a top surface and further including an aperture rim extending from said top surface of said top wall.

22. The orifice reducer of claim 21, wherein each of said top wall and said aperture rim has an edge, said edges being substantially circular.

23. The orifice reducer of claim 22, wherein said circumferential wall includes a plurality of reduced thickness regions.

24. The orifice reducer of claim 23, wherein said plurality of reduced thickness regions are radially symmetrically spaced.

25. The orifice reducer of claim 24, wherein each of said reduced thickness regions is defined by a notch.

26. The orifice reducer of claim 24, wherein each of said notches is substantially rectangular.

27. The orifice reducer of claim 24, wherein each of said notches is substantially semicircular.

28. The orifice reducer of claim 24, wherein said circumferential wall has a height and each of said notches extends at least approximately one half of said height of said circumferential wall, each of said notches contacting said second end of said circumferential wall.

29. A method of making an orifice reducer, comprising the steps of:

(a) forming a circumferential wall having an external surface;

(b) forming at least one axially extending reduced thickness region in the circumferential wall;

(c) forming a top wall attached to the circumferential wall, the top wall extending past the external surface of the circumferential wall; and (d) forming an aperture in the top wall.

30. The process of claim 29, further including the step of forming an outer wall attached to the top wall.

31. The process of claim 30, further including the step of forming a lip attached to the outer wall.

32. The process of claim 31, further including the step of forming an aperture rim on the top wall.

33. A method of manufacturing a container, comprising the steps of:

(a) forming a bottle, the bottle including a neck defining a neck opening;

(b) forming an orifice reducer with a circumferential wall, the circumferential wall having at least one vertically extending region of reduced thickness;

(c) placing the orifice reducer atop the neck of the bottle; and (d) applying pressure to the orifice reducer until the circumferential wall of the orifice reducer is inserted into the neck opening, wherein the circumferential wall may deform in the region of reduced thickness to facilitate insertion of the orifice reducer into the neck opening.

34. The method of claim 33, further including the steps of:

(e) forming a top wall on the orifice reducer that extends past the circumferential wall; and (f) applying pressure to the orifice reducer until the top wall rests on the neck.

35. A method of manufacturing a container comprising the steps of:

(a) forming a bottle, the bottle including a neck defining a neck opening;

(b) forming an orifice reducer with a circumferential wall, the circumferential wall having at least one vertically extending region of reduced thickness;

(c) placing the orifice reducer atop the neck of the bottle; and (d) applying pressure to the orifice reducer until the circumferential wall of the orifice reducer is inserted into the neck opening, (e) forming a top wall on the orifice reducer (f) applying pressure to the orifice reducer until the top wall rests on the neck;

(g) forming an outer wall on the orifice reducer; and (h) placing pressure on the orifice reducer until the outer wall surrounds an upper portion of the neck of the bottle.

36. The method of claim 35, further including the steps of:

(i) forming a lip on the outer wall;

(j) forming a ridge on the bottle; and (k) placing pressure on the orifice reducer until the lip snaps around the ridge.

37. The method of claim 36, wherein the step of forming the circumferential wall includes forming a plurality of axially extending reduced thickness regions in the circumferential wall.

38. The method of claim 37, wherein the axially extending reduced thickness regions are spaced symmetrically about the circumferential wall.

39. The method of claim 38, wherein the thickness of the reduced thickness regions is approximately one-half the thickness of the circumferential wall.

40. The method of claim 39, wherein each axially extending reduced thickness region extends to the bottom of the circumferential wall.

* * * * *